US010618713B2

(12) United States Patent
Beaird

(10) Patent No.: US 10,618,713 B2
(45) Date of Patent: Apr. 14, 2020

(54) RESEALABLE STORAGE AND DISPENSING DEVICE

(71) Applicant: Anthony Beaird, Cold Springs, CA (US)

(72) Inventor: Anthony Beaird, Cold Springs, CA (US)

( * ) Notice: Subject to any disclaimer, the term of this patent is extended or adjusted under 35 U.S.C. 154(b) by 0 days.

(21) Appl. No.: 16/032,129

(22) Filed: Jul. 11, 2018

(65) Prior Publication Data

US 2020/0017267 A1 Jan. 16, 2020

(51) Int. Cl.
*B65D 75/00* (2006.01)
*B65D 33/25* (2006.01)
*B65D 75/58* (2006.01)

(52) U.S. Cl.
CPC ..... *B65D 75/008* (2013.01); *B65D 33/2508* (2013.01); *B65D 75/5838* (2013.01); *B65D 2575/586* (2013.01)

(58) Field of Classification Search
CPC ..... B65D 75/008; B65D 33/2508; B65D 75/5838; B65D 2575/586
USPC ..... 383/906, 203, 204, 120, 16
See application file for complete search history.

(56) References Cited

U.S. PATENT DOCUMENTS

D373,674 S 9/1996 Dolinsky
6,857,779 B2 * 2/2005 Olin ..... B65D 33/2533 383/104
6,926,289 B2 8/2005 Wang
7,610,972 B2 11/2009 Adams et al.
7,900,731 B2 3/2011 McKinzie
2003/0016889 A1 * 1/2003 Ichikawa ..... B29C 45/14336 383/204
2007/0252351 A1 11/2007 McNamara
2010/0054634 A1 * 3/2010 Runyon ..... B65D 33/08 383/10
2014/0158446 A1 6/2014 Treadway
2015/0183554 A1 * 7/2015 Kessler, Jr. ..... B65D 33/065 383/10

FOREIGN PATENT DOCUMENTS

EP 1088767 A1 * 4/2001 ..... B65D 75/56

OTHER PUBLICATIONS

Machine translation of EP-1088767-A1.*

* cited by examiner

*Primary Examiner* — Jes F Pascua

(57) ABSTRACT

A resealable storage and dispensing device for granular dry goods includes a shell that defines an interior space. An orifice is positioned in a respective upper corner of the shell. The orifice is configured to dispense contents from the interior space as the shell is partially inverted. A first coupler and a second coupler are coupled to a front and a back of the shell, respectively, and are positioned in the interior space adjacent to the orifice. The second coupler is complementary to the first coupler. The second coupler is positioned to selectively and sealably couple to the first coupler to close the orifice.

7 Claims, 4 Drawing Sheets

RESEALABLE STORAGE AND DISPENSING DEVICE

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

(2) Description of Related Art Including Information Disclosed Under 37 CFR 1.97 and 1.98

The disclosure and prior art relates to storage devices and more particularly pertains to a new storage device for granular dry goods.

(h) BRIEF SUMMARY OF THE INVENTION

An embodiment of the disclosure meets the needs presented above by generally comprising a shell that defines an interior space. An orifice is positioned in a respective upper corner of the shell. The orifice is configured to dispense contents from the interior space as the shell is partially inverted. A first coupler and a second coupler are coupled to a front and a back of the shell, respectively, and are positioned in the interior space adjacent to the orifice. The second coupler is complementary to the first coupler. The second coupler is positioned to selectively and sealably couple to the first coupler to close the orifice.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
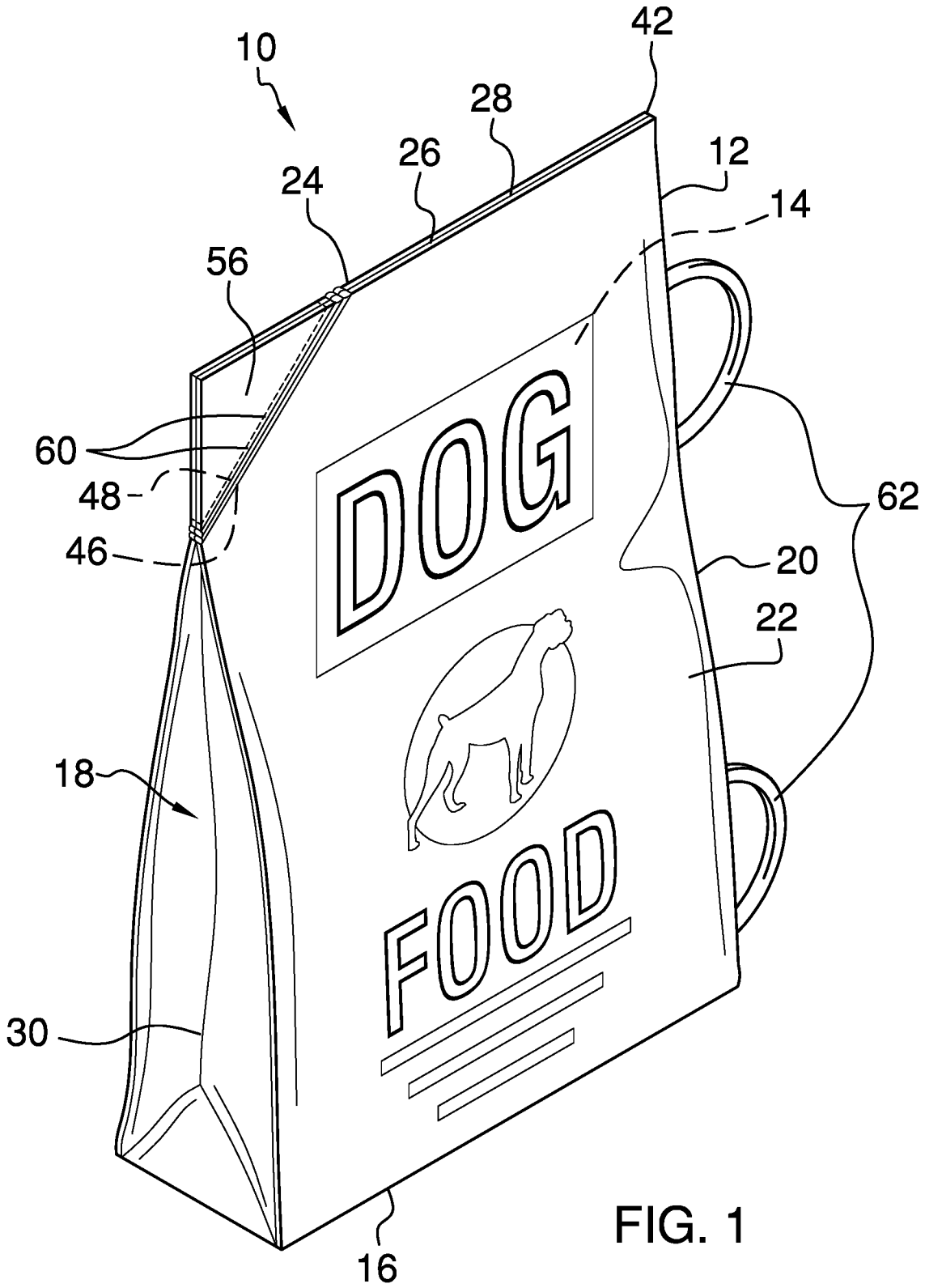
FIG. 1 is an isometric perspective view of a resealable storage and dispensing device according to an embodiment of the disclosure.

With reference now to the drawings, and in particular to FIGS. 1 through 4 thereof, a new storage device embodying the principles and concepts of an embodiment of the disclosure and generally designated by the reference numeral 10 will be described.

Figure 2:
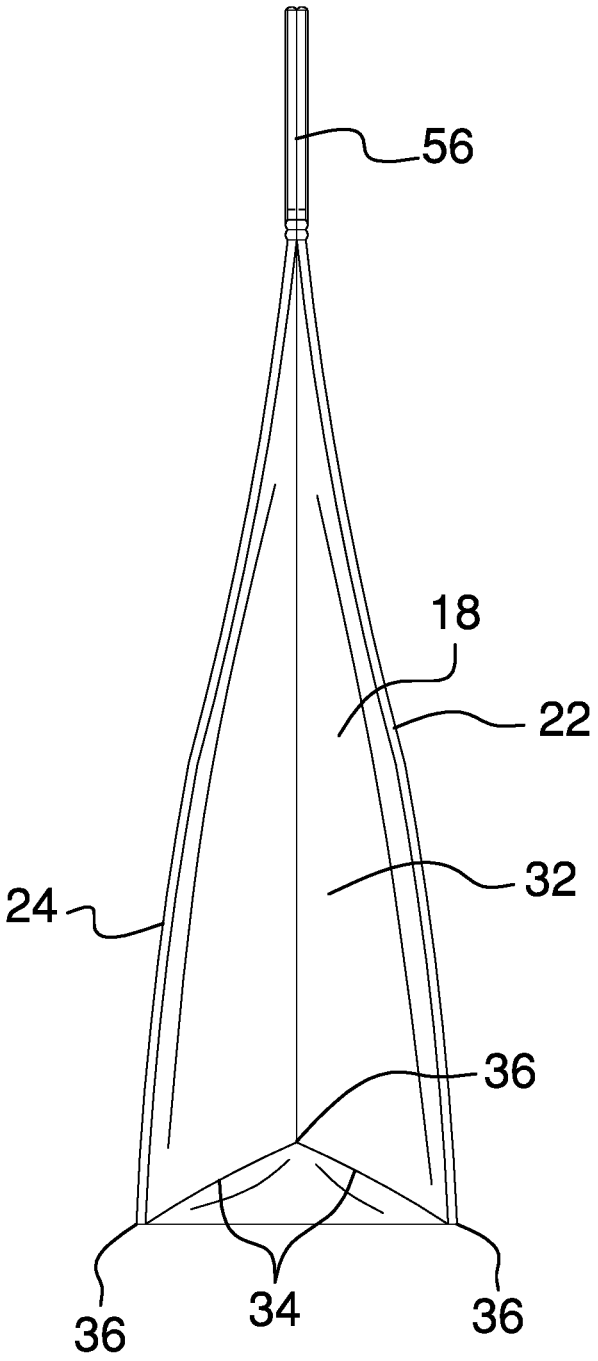
FIG. 2 is a side view of an embodiment of the disclosure.

As best illustrated in FIGS. 1 through 4, the resealable storage and dispensing device 10 generally comprises a shell 12 that defines an interior space 14. The shell 12 comprises a bottom 16, a first side 18, a second side 20, a front 22, and a back 24. The bottom 16, the front 22, and the back 24 are substantially rectangularly shaped. The first side 18 and the second side 20 are substantially triangularly shaped, as shown in FIG. 2, so that an intersection 26 of the front 22 and the back 24 defines a top 28 of the shell 12. The shell 12 is flexible so that the shell 12 is configured to be selectively collapsed.

Two sets of creases 30 are positioned singly is the first side 18 and the second side 20 of the shell 12, as shown in FIG. 2. Each set of creases 30 comprises a first element 32 and a pair of second elements 34. The first element 32 extends from the top 28 to proximate to the bottom 16 of the shell 12. Each second element 34 extends from a terminus 36 of the first element 32 to a respective lower corner 38 of the shell 12. The two sets of creases 30 are positioned to collapse the shell 12.

Figure 3:
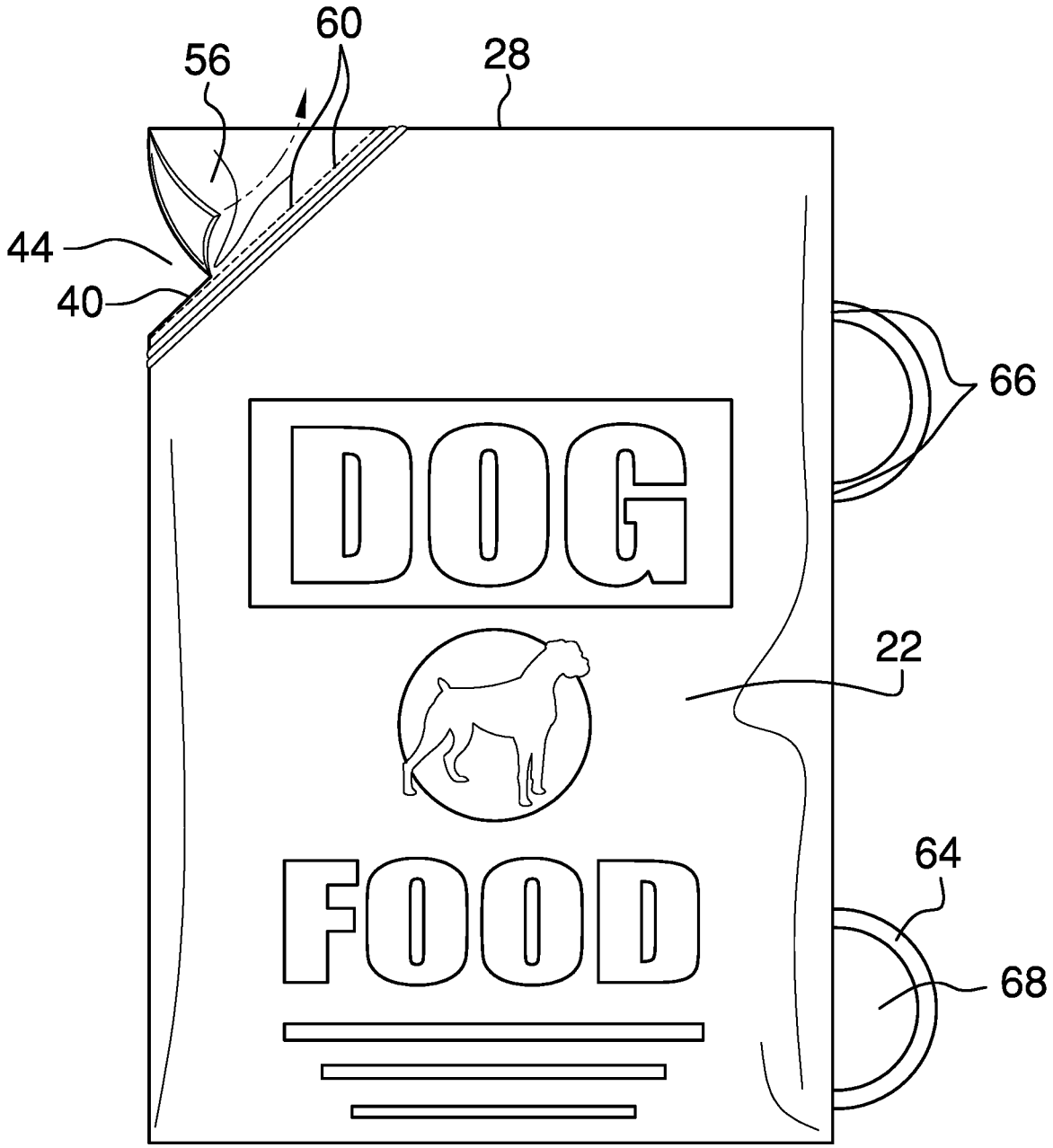
FIG. 3 is a front view of an embodiment of the disclosure.

An orifice 40 is positioned in a respective upper corner 42 of the shell 12, as shown in FIG. 3. The orifice 40 is configured to dispense contents, such as dry dog food, from the interior space 14 as the shell 12 is partially inverted. The orifice 40 comprises a pair of cutouts 44. The cutouts 44 are positioned singly in the front 22 and the back 24 of the shell 12 adjacent to the first side 18 and the top 28 of the shell 12.

Figure 4:
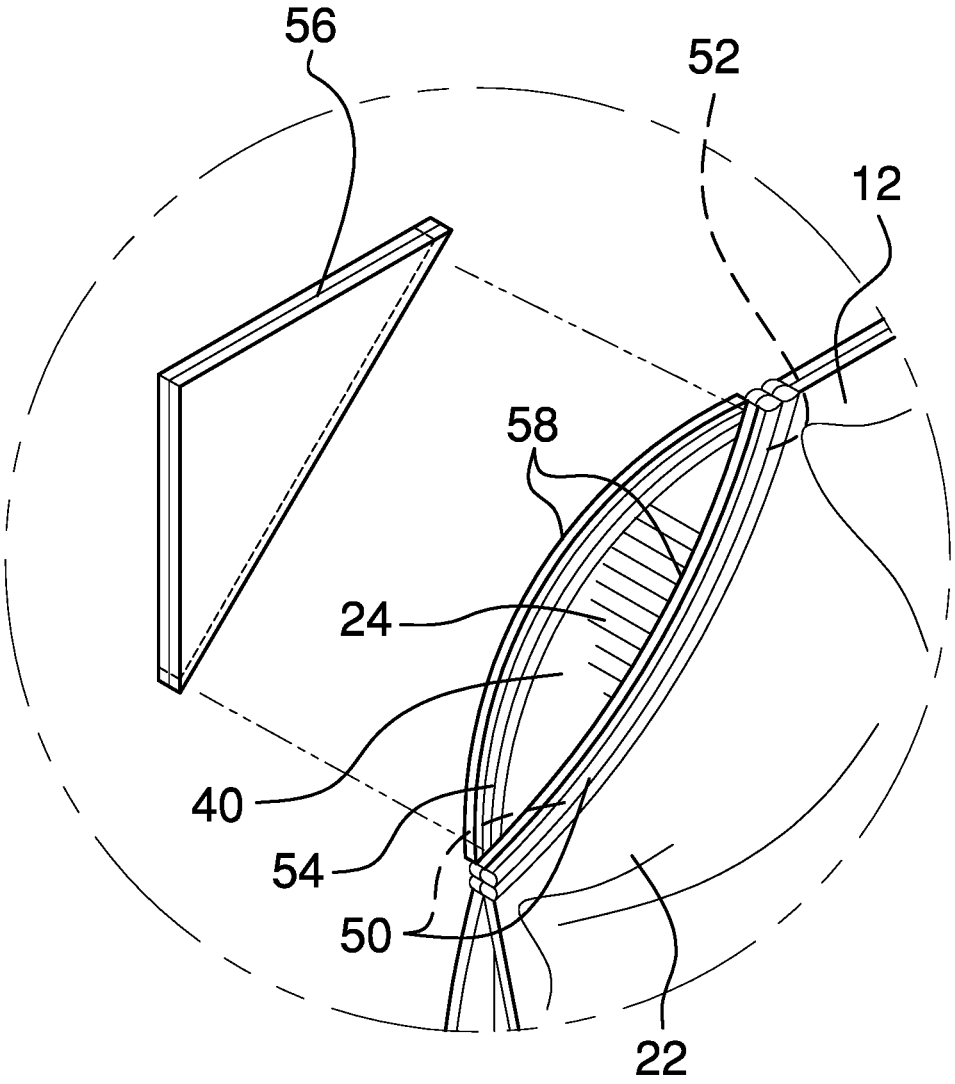
FIG. 4 is a detail view of an embodiment of the disclosure.

A first coupler 46 is coupled to the front 22 of the shell 12 and is positioned in the interior space 14 adjacent to the orifice 40, as shown in FIG. 4. A second coupler 48 is coupled to the back 24 of the shell 12 and is positioned in the interior space 14 adjacent to the orifice 40. The second coupler 48 is complementary to the first coupler 46. The second coupler 48 is positioned to selectively and sealably couple to the first coupler 46 to close the orifice 40.

The first coupler 46 comprises a pair of first ribs 50. The first ribs 50 extend in parallel between the top 28 and the first side 18 of the shell 12 to define a channel 52. The first ribs 50 are resilient. The second coupler 48 comprises a second rib 54 that extends between the top 28 and the first side 18 of the shell 12. The second rib 54 is resilient. The second rib 54 is positioned to be selectively inserted into the channel 52 to sealably close the orifice 40.

A panel 56 is coupled to and extends from a perimeter 58 of the orifice 40, as shown in FIG. 1. The panel 56 is triangularly shaped so that the panel 56 is complementary to the pair of cutouts 44. A plurality of perforations 60 is positioned through the panel 56. The perforations 60 extend linearly from proximate to the top 28 to proximate to the first side 18 of the shell 12. The panel 56 is configured to be grasped in a hand of a user to tear the panel 56 from the shell 12 to expose the orifice 40.

A plurality of handles 62 is coupled to the second side 20 of the bag, as shown in FIG. 3. Each handle 62 is configured to be grasped in the hand of the user to lift and to partially invert the shell 12 to dispense the contents of the interior space 14 through the orifice 40. The plurality of handles 62 comprises two handles 62 that are positioned singly proximate to the top 28 and the bottom 16 of the shell 12.

Each handle 62 comprises a strap 64 that has opposing ends 66. Each opposing end 66 is coupled to the shell 12 define a loop 68. Each loop 68 is configured to insert digits of a respective hand of the user to grasp an associated strap 64 to lift and to partially invert the shell 12 to dispense the contents of the interior space 14 through the orifice 40.

In use, the panel 56 is grasped in the hand of the user to tear the panel 56 from the shell 12 to expose the orifice 40. The user grasps the straps 64 to lift and to partially invert the shell 12 to dispense the contents of the interior space 14 through the orifice 40. The second rib 54 is selectively inserted into the channel 52 to sealably close the orifice 40.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A resealable storage and dispensing device comprising:

a shell defining an interior space, the shell comprising a bottom, a first side, a second side, a front, and a back, the bottom, the front, and the back being substantially rectangularly shaped, and the first side and the second side being substantially triangularly shaped such that an intersection of the front and the back of the shell defines a top of the shell;

an orifice positioned in a respective upper corner of the shell wherein the orifice is configured for dispensing contents from the interior space as the shell is partially inverted, the orifice comprising a pair of cutouts positioned singly in the front and the back of the shell adjacent to the first side and the top of the shell;

a first coupler coupled to a front of the shell and positioned in the interior space adjacent to the orifice, the first coupler comprising a pair of first ribs extending in parallel between the top and the first side of the shell defining a channel, the first ribs being resilient; and a second coupler coupled to a back of the shell and positioned in the interior space adjacent to the orifice, the second coupler being complementary to the first coupler wherein the second coupler is positioned for selectively sealably coupling to the first coupler for closing the orifice, the second coupler comprising a second rib extending between the top and the first side of the shell, the second rib being resilient wherein the second rib is positioned for selectively inserting into the channel for sealably closing the orifice;

a plurality of handles coupled to the second side of the bag wherein each handle is configured for grasping in a hand of a user for lifting and partially inverting the shell for dispensing the contents of the interior space through the orifice, each handle comprising a strap having opposing ends, each opposing end being coupled directly to the second side of the shell defining a loop with the second side of the shell wherein each loop is configured for inserting digits of a respective hand of the user for grasping an associated strap for lifting and partially inverting the shell for dispensing the contents of the interior space through the orifice, said opposing ends of each of said strap being spaced apart along said second side between said top and said bottom wherein each handle is positioned in a plane oriented perpendicular to said bottom of said shell.

2. The device of claim 1, further including the shell being flexible such that the shell is configured for selectively collapsing.

3. The device of claim 2, further including two sets of creases positioned singly is the first side and the second side of the shell, each set of creases comprising a first element and a pair of second elements, the first element extending from the top to proximate to the bottom of the shell, each second element extending from a terminus of the first element to a respective lower corner of the shell wherein the set of creases are positioned for collapsing the shell.

4. The device of claim 1, further comprising:

a panel coupled to and extending from a perimeter of the orifice; and a plurality of perforations positioned through the panel, the perforations extending linearly from proximate to the top to proximate to the first side of the shell wherein the panel is configured for grasping in a hand of a user for tearing the panel from the shell for exposing the orifice.

5. The device of claim 4, further including the panel being triangularly shaped such that the panel is complementary to the pair of cutouts.

6. The device of claim 1, further including the plurality of handles comprising two handles positioned singly proximate to the top and the bottom of the shell.

7. A resealable storage and dispensing device comprising:

a shell defining an interior space, the shell comprising a bottom, a first side, a second side, a front, and a back, the bottom, the front, and the back being substantially rectangularly shaped, the first side and the second side being substantially triangularly shaped such that an intersection of the front and the back of the shell defines a top of the shell, the shell being flexible such that the shell is configured for selectively collapsing;

two sets of creases positioned singly is the first side and the second side of the shell, each set of creases comprising a first element and a pair of second elements, the first element extending from the top to proximate to the bottom of the shell, each second element extending from a terminus of the first element to a respective lower corner of the shell wherein the set of creases are positioned for collapsing the shell;

an orifice positioned in a respective upper corner of the shell wherein the orifice is configured for dispensing contents from the interior space as the shell is partially inverted, the orifice comprising a pair of cutouts positioned singly in the front and the back of the shell adjacent to the first side and the top of the shell;

a first coupler coupled to the front of the shell and positioned in the interior space adjacent to the orifice;

a second coupler coupled to the back of the shell and positioned in the interior space adjacent to the orifice, the second coupler being complementary to the first coupler wherein the second coupler is positioned for selectively sealably coupling to the first coupler for closing the orifice, the first coupler comprising a pair of first ribs extending in parallel between the top and the first side of the shell defining a channel, the first ribs being resilient, the second coupler comprising a second rib extending between the top and the first side of the shell, the second rib being resilient wherein the second rib is positioned for selectively inserting into the channel for sealably closing the orifice;

a panel coupled to and extending from a perimeter of the orifice, the panel being triangularly shaped such that the panel is complementary to the pair of cutouts;

a plurality of perforations positioned through the panel, the perforations extending linearly from proximate to the top to proximate to the first side of the shell wherein the panel is configured for grasping in a hand of a user for tearing the panel from the shell for exposing the orifice; and a plurality of handles coupled to the second side of the bag wherein each handle is configured for grasping in the hand of the user for lifting and partially inverting the shell for dispensing the contents of the interior space through the orifice, the plurality of handles comprising two handles positioned singly proximate to the top and the bottom of the shell, each handle comprising a strap having opposing ends, each opposing end being coupled directly to the second side of the shell defining a loop with the second side of the shell wherein each loop is configured for inserting digits of a respective hand of the user for grasping an associated strap for lifting and partially inverting the shell for dispensing the contents of the interior space through the orifice, said opposing ends of each of said strap being spaced apart along said second side between said top and said bottom wherein each handle is positioned in a plane oriented perpendicular to said bottom of said shell.

* * * * *